US005975251A

United States Patent [19]

McCarthy

[11] Patent Number: 5,975,251

[45] Date of Patent: Nov. 2, 1999

[54] ROCKER BRAKE ASSEMBLY WITH HYDRAULIC LOCK

[75] Inventor: Donald J. McCarthy, Wethersfield, Conn.

[73] Assignee: Diesel Engine Retarders, Inc., Wilmington, Del.

[21] Appl. No.: 09/165,291

[22] Filed: Oct. 2, 1998

Related U.S. Application Data

[60] Provisional application No. 60/080,286, Apr. 1, 1998.

[51] Int. Cl.[6] ..... F02D 13/04

[52] U.S. Cl. ..... 188/31; 188/273; 123/321; 123/90.39

[58] Field of Search ..... 123/90.16, 90.27, 123/90.44, 321, 432, 90.23, 90.17, 198 F, 90.39, 90.12, 90.43, 193.5, 315, 308, 322, 90.46, 323; 188/273, 154, 31, 60, 265, 69, 67; 74/559; 303/89

[56] References Cited

U.S. PATENT DOCUMENTS 4,612,887 9/1986 Yoshizaki ..... 123/90.39

4,726,332 2/1988 Nishimura et al. ..... 123/90.39

5,626,116 5/1997 Reedy et al. .

*Primary Examiner*—Douglas C. Butler

*Attorney, Agent, or Firm*—Collier, Shannon, Rill & Scott, PLLC

[57] ABSTRACT

The present invention is directed to a locking assembly for use in a rocker arm assembly for an engine brake assembly. The rocker arm assembly includes a rocker arm pivotally mounted on a shaft. The rocker arm has a first end and a second end, wherein the first end includes a cam follower and the second end includes an actuator assembly for operating at least one valve during a braking operation. The improved rocker arm includes a locking assembly for releasably securing the rocker arm to the shaft to prevent pivoting of the rocker arm during a positive power operation. The locking assembly includes a releasable latching assembly located on one of the rocker arm and the shaft. The locking assembly also includes a latch receiving recess located on another of the rocker arm and the shaft. The releasable latching assembly engages the latch receiving recess during a positive power operation. The releasable latching assembly disengaging the latch receiving recess during an engine braking operation such that the rocker arm can pivot about the shaft.

6 Claims, 3 Drawing Sheets

ROCKER BRAKE ASSEMBLY WITH HYDRAULIC LOCK

CROSS-REFERENCE TO RELATED APPLICATIONS

This application is related and claims priority to U.S. Provisional application Ser. No. 60/080,286, filed Apr. 1, 1998.

FIELD OF THE INVENTION

The present invention relates generally to a locking assembly for use on a rocker arm of an engine brake assembly. In particular, the present invention relates to a hydraulic detent lock for use on a rocker arm of an engine brake assembly to lock the rocker arm in place when the brake is deactivated.

BACKGROUND OF THE INVENTION

When a rocker brake assembly of an engine brake is deactivated during positive power, the rocker brake assembly is free to rotate on the rocker shaft. Because the rocker brake assembly is free to rotate, it may come into contact with the exhaust valves and the cam assembly. This contact may cause damage to the rocker brake assembly and the valves.

One attempt to solve this problem was developed by Jacobs Vehicle Systems and is depicted in FIG. 5. The rocker brake assembly 30 includes a wire form spring assembly 31 activating between the rocker arm 32 and the rocker shaft 33. The spring assembly 31 urges the rocker arm 32 to a neutral position when the rocker brake assembly 30 is deactivated. The spring assembly 31, however, may wear prematurely which may cause undue wear on the brake housing. If this occurs then the spring assembly 31 does not perform its primary function of maintaining the brake assembly 30 in a neutral position.

OBJECTS OF THE INVENTION

It is an object of the present invention to provide a positive lock between a rocker arm and its associated shaft.

It is another object of the present invention to provide a positive lock for a rocker arm having improved wear resistance.

It is another object of the present invention to provide a low cost positive lock for a rocker arm.

It is another object of the present invention to provide a locking mechanism to prevent oscillation of a rocker brake during normal engine operation.

It is another object of the present invention to provide a locking mechanism to prevent oscillation of a rocker brake to prevent damage to the rocker arm assembly and/or the at least one valve through inadvertent contact during normal engine operation.

It is another object of the present invention to provide a locking mechanism to prevent oscillation of a rocker brake to prevent damage to the rocker arm assembly and the brake cam lobe through inadvertent contact during normal engine operation.

SUMMARY OF THE INVENTION

The present invention is directed to a locking assembly for use in a rocker arm assembly for an engine brake assembly. The rocker arm assembly includes a rocker arm pivotally mounted on a shaft. The rocker arm has a first end and a second end, wherein the first end includes a cam follower and the second end includes an actuator assembly for operating at least one valve during a braking operation. The improved rocker arm includes a locking assembly for releasably securing the rocker arm to the shaft to prevent pivoting of the rocker arm during a positive power operation.

The locking assembly includes a releasable latching assembly located on one of the rocker arm and the shaft. The locking assembly also includes a latch receiving recess located on the other of the rocker arm and the shaft. The releasable latching assembly engages the latch receiving recess during a positive power operation. The releasable latching assembly disengages the latch receiving recess during an engine braking operation such that the rocker arm can normally pivot about the shaft.

The releasable latching assembly may be located on the rocker arm whereby the latch receiving recess is located on the shaft. The locking assembly further includes a biasing assembly for biasing the releasable latching assembly into the latch receiving recess during the positive power operation.

BRIEF DESCRIPTION OF THE DRAWINGS

The invention will be described in conjunction with the following drawings in which like reference numerals designate like elements and wherein.

DETAILED DESCRIPTION OF THE PREFERRED EMBODIMENTS

Figure 1:
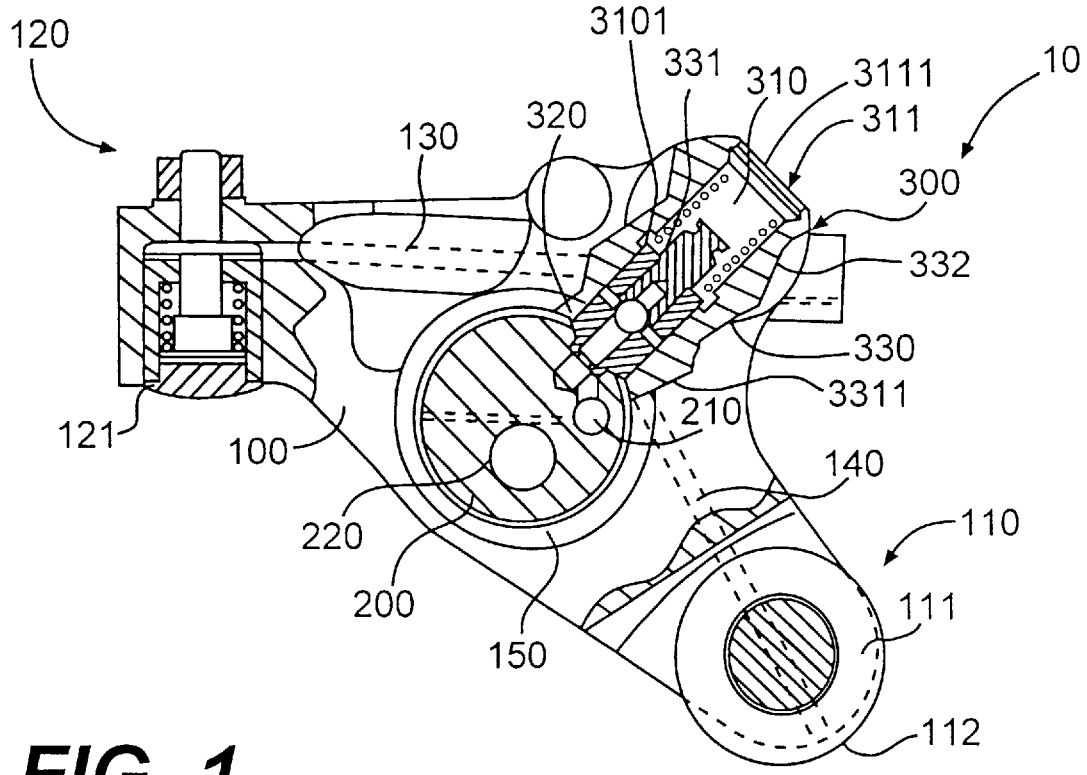
FIG. 1 is a side view of a rocker arm for an engine brake having a locking mechanism in a locked position in accordance with an embodiment of the present invention.

FIG. 1 depicts a brake rocker arm assembly 10 having a brake rocker arm 100 that is rotatably mounted on a rocker shaft 200. The brake rocker arm assembly 10 also includes a locking assembly 300 for releasably securing the rocker arm 100 to the shaft 200. The brake rocker arm 100 and the rocker shaft 200 will now be described.

The brake rocker arm 100 pivots about the rocker shaft 200 and includes a first end 110 and a second end 120. The first end 110 of the brake rocker arm 100 includes a brake cam lobe follower 111. The brake cam lobe follower 111 may includes a roller follower 112 that is in contact with a brake cam lobe, not shown.

The second end 120 of the brake rocker arm 100 includes an actuator assembly 121. The actuator assembly 121 is spaced from the crosshead of an exhaust rocker arm, not shown. When activated, the brake rocker arm 100 and the actuator assembly 121 contact the crosshead pin, not shown, of the crosshead to open the at least one exhaust valve to perform a braking operation.

The brake rocker arm 100 also includes a fluid passageway 130 that extends from the actuator assembly 121.

Hydraulic fluid from a passageway 210 in the shaft 200 may be supplied to the fluid passageway 130 to operate the actuator assembly 121. The supply of hydraulic fluid is preferably a high pressure supply. A solenoid valve, not shown, may be mounted to the shaft 200 to control the flow of fluid within the hydraulic passageway 210. Alternatively, the solenoid valve may be mounted on the rocker arm. The brake rocker arm 100 also includes a fluid passageway 140 that extends to the follower 111 and a fluid passageway 150 that extends around the periphery of the shaft 200. Hydraulic fluid from the passageway 210 in the shaft 200 may be supplied to the fluid passageway 140 to lubricate the follower 111. Hydraulic fluid from a passageway 220 in the shaft 200 may also be supplied to the fluid passageway 150 to provide lubrication between the brake rocker arm 100 and the shaft 200 to provide smooth operation of the brake rocker arm 100.

Alternatively, hydraulic fluid from a passageway 220 in the shaft 200 may be supplied to the fluid passageway 140 to lubricate the follower 111. Hydraulic fluid from passageway 220 may also be supplied to the fluid passageway 150 to provide lubrication between the brake rocker arm 100 and the shaft 200 to provide smooth operation of the brake rocker arm 100.

Figure 2:
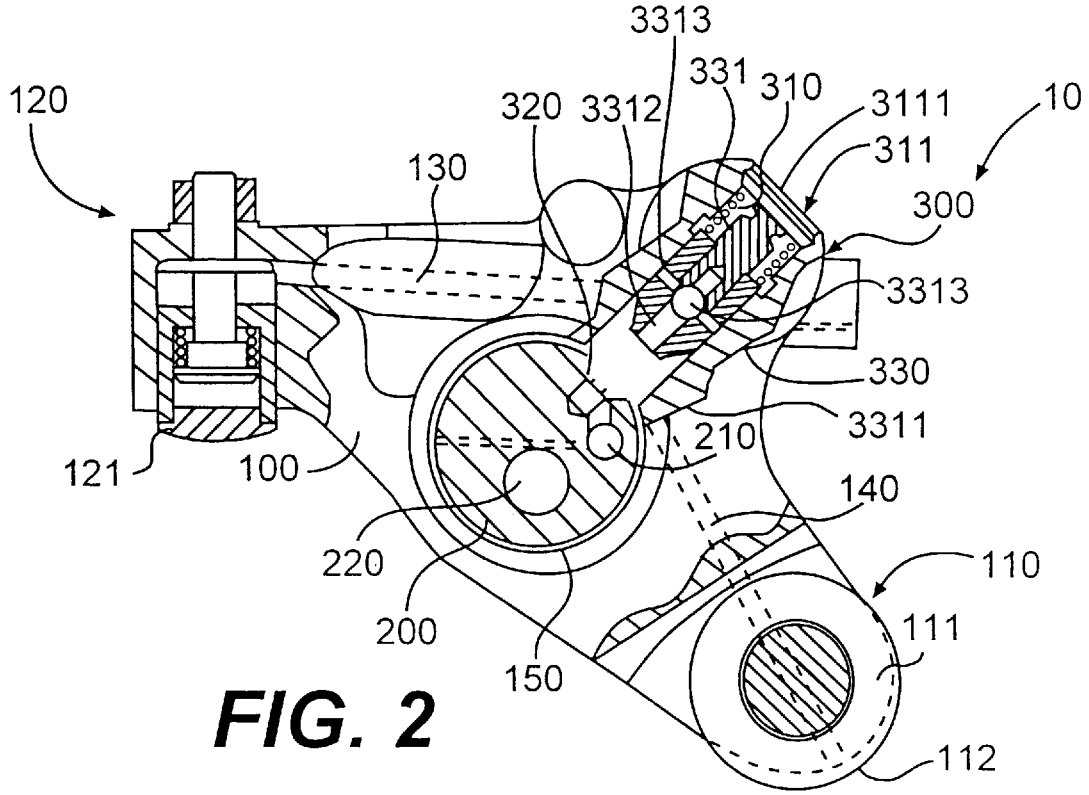
FIG. 2 is a side view of the rocker arm of FIG. 1 having the locking mechanism in a retracted position.

The locking assembly 300 according to an embodiment of the present invention will now be described in connection with FIGS. 1 and 2. The brake rocker arm 100 includes a bore 310. One end of the bore 310 is closed or covered with an end cap 311, as shown for example in FIG. 1. The other end of the bore 310 opens into a latch receiving recess 320 in the shaft 200. A releasable latching assembly 330 is located within the bore 310.

The releasable latching assembly 330 includes a valve assembly 331 that is movably mounted within the bore 310. A biasing assembly 332, such as, for example, a spring, biases the valve assembly 331 within the bore 310 towards the latch receiving recess 320.

The valve assembly 331 includes latching assembly 3311 located at one end. The latching assembly 3311 is complimentary with the latch receiving recess 320. When the brake rocker arm 100 is not operational (i.e., during positive power), the latching assembly 3311 is received within the latch receiving recess 320. In a preferred embodiment, the latching assembly 3311 is a detent, as shown in FIGS. 1 and 2.

The valve assembly 331 also includes a passageway 3312 that extends from the latching assembly 3311. A check valve 3313 is positioned within the passageway 3312, as shown in FIGS. 1 and 2. A radial passageway 3313 is also provided in the valve assembly 331. With this arrangement, hydraulic fluid may flow from the passageway 210 to the latch receiving recess 320. Hydraulic fluid may then flow through the passageway 3312 in the valve assembly 331 dislodging the check valve 3313. Hydraulic fluid then flows through radial passageway 3313 into fluid passageway 3130 to operate the actuator assembly 121 during a braking operation.

The bore 310 includes a groove 3101 located therein. The groove 3101 permits hydraulic fluid to drain from the passageway 1130 through the valve assembly 331 to the bore 310. The hydraulic fluid can then drain through at least one aperture 3111 in the end cap 311.

The operation of the brake rocker assembly 10 containing the locking assembly will now be described.

Operation of Brake Rocker Arm Assembly During Positive Power

The operation of the brake rocker arm 300 during positive power operation will now be described. During positive power, the solenoid valve, described above, associated with the hydraulic passageway 210 remains closed. As a result, hydraulic fluid does not flow through the passageway 210 to the latch receiving recess 320. The bias of the biasing assembly 332 forces the latching assembly 3311 of the valve assembly 331 into the latch receiving recess 320. In this position, the rocker arm 100 does not oscillate during positive power. Furthermore, when the rocker arm 100 is in a locked position as shown in FIG. 1, the actuator assembly 121 does not contact the at least one exhaust valve, which minimizes potential damage to the crosshead from unintended impact. Additionally, the brake cam lobe follower 111 does not contact the brake arm lobe, not shown, which further minimizes potential damage from unintended contact with the lobe.

Operation of Brake Rocker Arm Assembly During Braking

The operation of the brake rocker arm 300 during an engine braking operation will now be described. During engine braking, the solenoid valve associated with the shaft 200 is operated. Hydraulic fluid is permitted to flow from passage 210 to the latch receiving recess 320. The hydraulic fluid within the latch receiving recess 320 also moves the valve assembly 331 within the bore 310 to a position illustrated in FIG. 1. The high pressure fluid exerts a sufficient amount of force on the valve assembly 331 to overcome the biasing force of the biasing assembly 332. As a result, the latching assembly 3311 is withdrawn from the latch receiving recess 320. The brake rocker arm 100 is then permitted to pivot about shaft 200. The high pressure hydraulic fluid then flows from the latch receiving recess 320 through the passageway 3312 in the valve assembly 331. The hydraulic fluid biases the check valve 3313 to permit flow of fluid through the radial passageway 3313 to fluid passageway 130.

The movement of the valve assembly 331 opens an opening 312 in the bore 310 to permit hydraulic fluid to flow through fluid passageway 140 to lubricate the follower 111, as described above. When the valve assembly 331 is in a retracted position, hydraulic fluid may be permitted to flow directly from the bore 310 to the fluid passageway 130. The actuator assembly 121 then extends to a fully extended position as shown in FIG. 2 such that it contacts a pin on the crosshead to actuate at least one exhaust valve. When the passageway 130 is filled with hydraulic fluid and the pressure is equalized, a hydraulic lock is formed thus holding the actuator assembly 121 in an extended position. The operation of the exhaust valve is now controlled by the brake rocker arm 300 in response to actuation by the brake cam lobe. The operation of the exhaust valves will occur in response to the profile of the brake cam lobe.

When the engine braking operation is complete, the solenoid valve associated with the passageway 210 in shaft 200 is closed. High pressure hydraulic fluid is no longer permitted to flow to the latch receiving recess 320. The pressure of the hydraulic fluid within the bore 310 and the recess 320 is insufficient to overcome the bias of the biasing assembly 332. As a result, the valve assembly 331 returns to a position shown in FIG. 1. The latching assembly 3311 moves into contact with the recess 320, which locks the brake rocker arm 100 in a fixed position such that it does not oscillate during positive power. Hydraulic fluid within passageway 130 is permitted to drain to bore 310 and through the apertures 3111 in the end cap 311.

The tapered end design of the latching assembly 3311 ensures proper alignment of the valve assembly 331 within the recess 320. The tapered end of the mating assembly 3311 when contacting the beveled edge of the recess 320 under the bias of the biasing assembly 332 causes the rocker arm 100 to pivot about the shaft 200 such that the latching assembly 3311 is properly aligned within the recess 320 to prevent damage to the rocker arm 100, as described above, during positive power.

Alternate Embodiments

Figure 3:
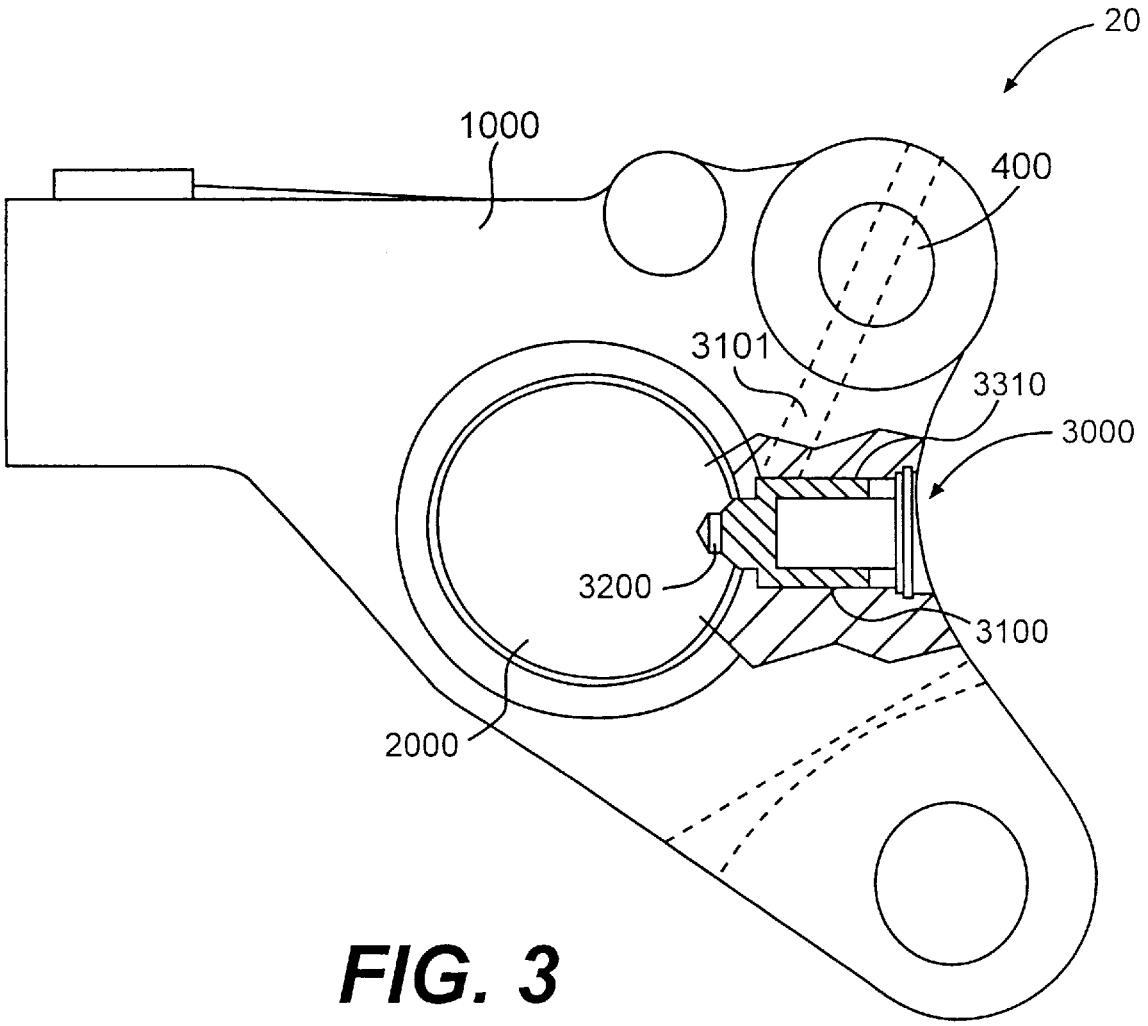
FIG. 3 is a side view of a rocker arm for an engine brake having a locking mechanism in a locked position in accordance with another embodiment of the present invention.
Figure 4:
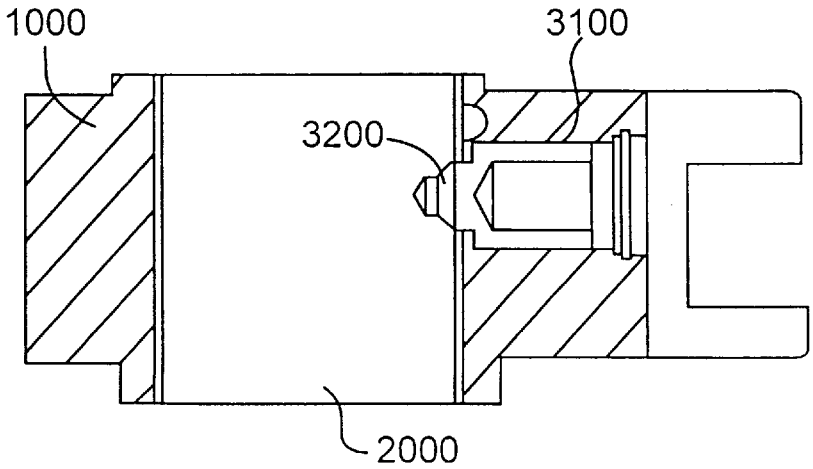
FIG. 4 is a cross sectional view of the rocker arm and locking mechanism of FIG. 3 along section line IV—IV.
Figure 5:
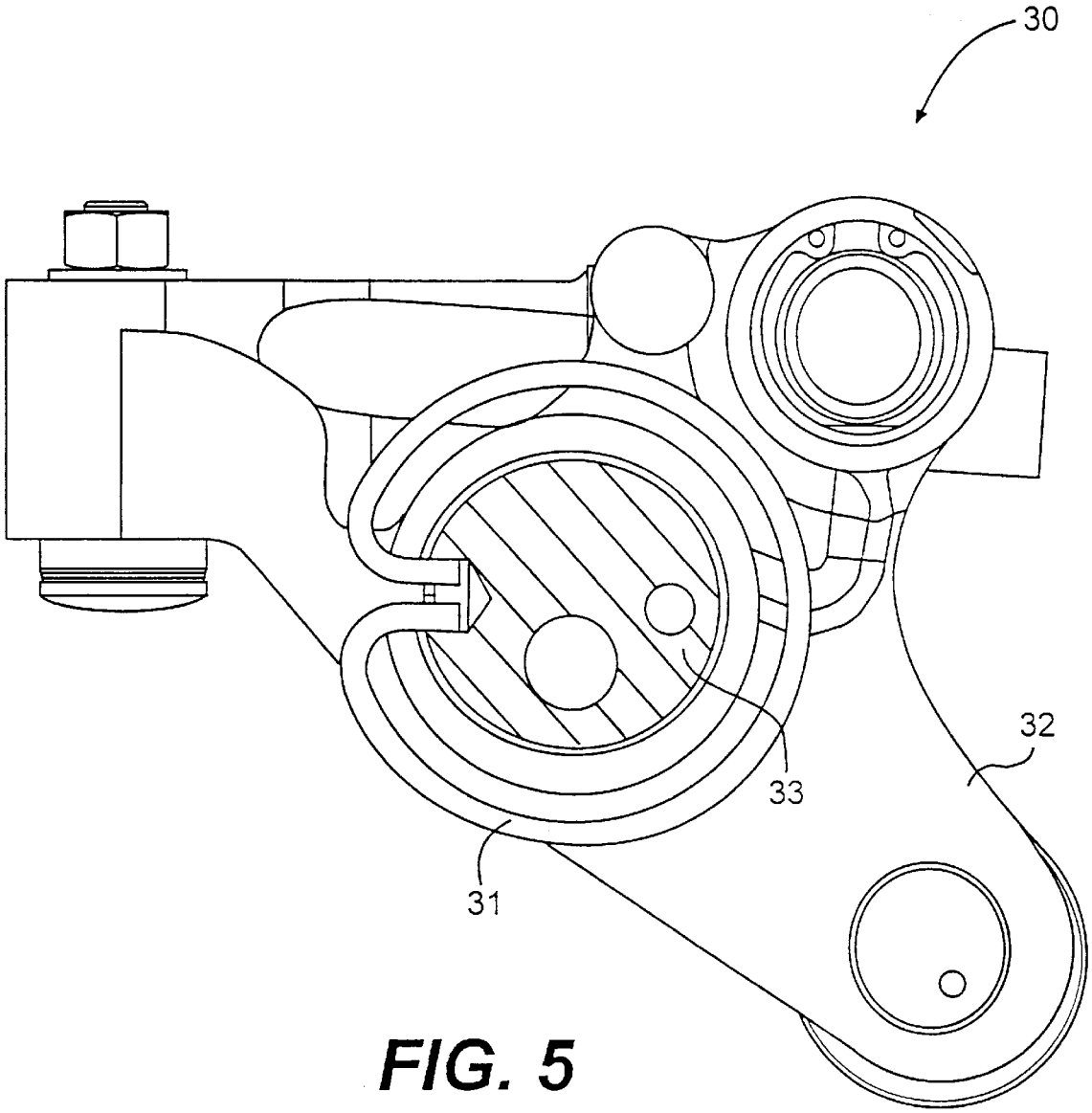
FIG. 5 PRIOR ART
FIG. 5 is schematic of wire form spring assembly for controlling rotation of the rocker brake arm during positive power.

FIGS. 3 and 4 depict another embodiment of the locking mechanism according to the present invention. The brake rocker arm assembly 20 includes a brake rocker arm 1000 that is rotatably mounted on a rocker shaft 2000. The rocker arm 1000 has a similar construction to the rocker arm 100, described above. The actuator assembly, follower and passageways are not illustrated in FIGS. 3 and 4. However, their construction and arrangement are similar to the brake rocker arm 100. The brake rocker arm assembly 20 includes a locking assembly 3000.

In the embodiment illustrated in FIGS. 3 and 4, the locking mechanism is distinct from the control valve that supplies hydraulic fluid to the actuator assembly. The shaft 2000 includes a latch receiving recess 3200. The recess 3200 has a similar to that described above in connection with recess 320. High pressure hydraulic fluid is supplied to the recess 3200 in the manner described above in connection with recess 320.

In addition to the latch receiving recess 3200, the locking mechanism 3000 includes a bore 3100 formed in the brake rocker arm 1000. Located within the bore 3100 is a latching mechanism 3310. The latching mechanism 3310 has a similar construction to the latching assembly 3311, described above. The embodiment of FIGS. 3 and 4 differ from brake rocker arm assembly 10 in that the control valve and latching mechanism 3310 are formed as separate structures. The latching mechanism 3310 is slidably received within bore 3100. A biasing assembly, not shown, a similar construction to biasing assembly 332, biases the latching mechanism 3310 within bore 3100 into engagement with the latch receiving recess 3200.

As described above, a solenoid valve permits the supply of hydraulic fluid under high pressure to the latch receiving recess 3200. The hydraulic fluid supplies sufficient force to move the latching mechanism 3310 against the bias of the biasing assembly such that the latching mechanics 3310 is no longer received within recess 3200. The brake rocker arm 1000 is then capable of rotating about shaft 2000. A passageway 3101 extends from bore 3100 to a control valve assembly 400. Hydraulic fluid is fed through the bore 3100 to passageway 3101 through control valve assembly 400 to operate the actuator assembly during an engine braking event.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. In a rocker arm assembly for an engine brake assembly, said rocker arm assembly comprising a rocker arm pivotally mounted on a shaft, said rocker arm having a first end and a second end, wherein said first end includes a cam follower and said second end includes an actuator assembly for operating at least one valve during a braking operation, the improvement comprising:

locking means for releasably securing said rocker arm to said shaft to prevent pivoting of said rocker arm during a positive power operation, wherein said locking means comprises:

a releasable latching assembly located on one of said rocker arm and said shaft; and a latch receiving recess located on another of said rocker arm and said shaft, wherein said releasable latching assembly engaging said latch receiving recess during a positive power operation, and said releasable latching assembly disengaging said latch receiving recess during an engine braking operation.

2. The rocker arm assembly according to claim 1, wherein said releasable latching assembly is located on said rocker arm, and said latch receiving recess is located on said shaft.

3. The rocker arm assembly according to claim 1, wherein said locking means further comprises:

biasing means for biasing said releasable latching assembly into said latch receiving recess during the positive power operation.

4. The rocker arm assembly according to claim 1, wherein said releasable latching assembly is hydraulically operated.

5. The rocker arm assembly according to claim 4, wherein a valve assembly controls the hydraulic operation of said releasable latching assembly.

6. The rocker arm assembly according to claim 1, wherein the actuator assembly is in an extended position during the braking operation and a retracted position during the positive power operation, wherein said locking means prevents the actuator assembly from moving to the retracted position from the extended position during the positive power operation.

* * * * *